United States Patent [19]

Strickland

[11] Patent Number: 4,646,858

[45] Date of Patent: Mar. 3, 1987

[54] EARTH BORING BIT WITH AIR SYSTEM ACCESS

[75] Inventor: Robert M. Strickland, Houston, Tex.

[73] Assignee: Hughes Tool Company - USA, Houston, Tex.

[21] Appl. No.: 725,051

[22] Filed: Apr. 19, 1985

[51] Int. Cl.[4] ..... E21B 10/18

[52] U.S. Cl. ..... 175/337; 175/339; 384/92; 215/36

[58] Field of Search ..... 175/337, 339, 227–229; 384/92–96; 215/294, 360; 202/325, 327

[56] References Cited

U.S. PATENT DOCUMENTS

| | | | |
|---|---|---|---|
| 1,294,106 | 2/1919 | Humason | 175/227 |
| 1,758,774 | 5/1930 | Zublin | 175/298 |
| 1,918,902 | 7/1933 | Fletcher et al. | 175/337 |
| 2,072,802 | 3/1937 | Kraft | 215/360 X |
| 2,861,780 | 11/1958 | Butler | 175/337 X |
| 2,886,067 | 5/1959 | Maxwell et al. | 215/360 X |
| 4,014,595 | 3/1977 | Dolezal | 175/228 X |
| 4,245,710 | 1/1981 | Dolezal et al. | 175/337 |
| 4,294,492 | 10/1981 | Evans | 384/94 |
| 4,310,029 | 1/1982 | Dudek | 215/360 X |
| 4,446,933 | 5/1984 | Bodine | 175/229 |
| 4,515,229 | 5/1985 | Drummond et al. | 175/337 |
| 4,548,280 | 10/1985 | Daly et al. | 175/228 X |

*Primary Examiner*—Stephen J. Novosad
*Assistant Examiner*—David J. Bagnell
*Attorney, Agent, or Firm*—Robert A. Felsman

[57] ABSTRACT

An earth boring bit of the "air cooled" type that includes an air passage access system, including a generally vertical passage with an opening on the exterior of the leg or in the shank cavity that forms part of the body of the bit. This vertical passage is accessible through the opening by removal of a core that expands or retracts by altering the pressure exerted against it by two plates and a threaded fastener.

3 Claims, 2 Drawing Figures

Fig. 1
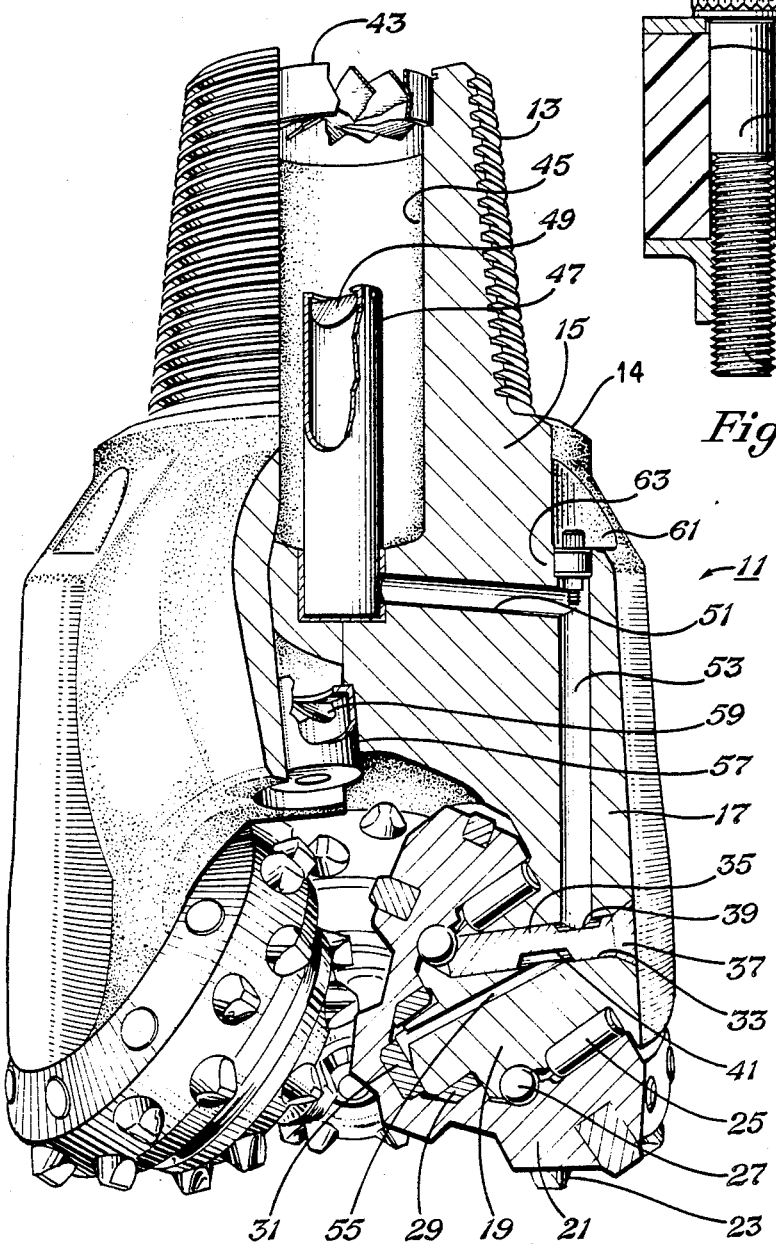
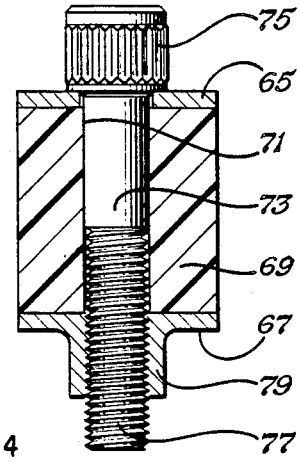
Fig. 2

EARTH BORING BIT WITH AIR SYSTEM ACCESS

BACKGROUND OF THE INVENTION

1. Field of the Invention

This invention relates generally to earth boring, especially to improvements to bits having cutters rotatively secured to bearing shafts, with air passages through the interior of the bit and bearings to enable air or gas cooling of the bearings.

2. Background Information

Earth boring bits of the rolling cutter type consist of three general types: (1) Those having sealed bearings that are lubricated with a liquid lubricant confined in the bearing area, (2) those having open bearings where the fluid in the well bore is free to enter the bearings, and (3) the air or gas cooled, unsealed bit that has unsealed bearings cooled by the flow of fluid through passages in the body and the bearing of each leg.

Inevitably, it seems, there are some liquid and particles of dust or other debris pumped through the drill pipe supporting the bit. Often there is particle contaminated water on the bottom of the hole that flows backwardly into the bit when the air supply is stopped. All too frequently these ingredients form obstructions in one or more of the passages leading to the bearings, block the flow of cooling fluid and cause excessive heating and failure of one of the bearings.

Since the so called "air bit" is often used to drill repeatedly shallow holes in the mining industry, the accumulation of detritus in the passages of the bit is manually removed by the workers. This task is difficult since access to the internal air passages is limited, and may involve the removal from inside the shank of the screening tubes used over the cooling passages. Then, water is flushed through the passages, and a rod used to dislodge the blockage. These cleaning efforts are time consuming and difficult, partly because access to the passages is restricted.

SUMMARY OF THE INVENTION

The general object of the invention is to provide, in an earth boring bit, improved means to access the cooling passages used to direct air or gas to the bearings between the rotatable cutter and shaft. To accomplish this object each leg of the bit has a generally vertical segment with an opening on the exterior of the body. A removable plug is inserted into this opening, and may be removed to permit access to the interior passages to remove obstructions. The preferred plug has an expandable, elastomeric portion used to seal the opening, and the body of the plug comprises an upper and lower plate to confine and expand the elastomeric portion by means of a threaded fastener extending through the assembly.

The above as well as additional objects, features and advantages of the invention will become apparent in the following description.

DESCRIPTION OF THE DRAWING

FIG. 1 of the drawing is a perspective view, partially in longitudinal section, to expose the interior of one leg of the body of an earth boring drill bit and the rotatable cutter which the leg supports. The cooling passages are shown, as is the access system of the invention.

FIG. 2 is a view of the preferred, removable plug, partially in longitudinal section to show the components of the assembly.

DESCRIPTION OF THE PREFERRED EMBODIMENT

The numeral 11 in FIG. 1 of the drawing designates an earth boring bit having a threaded upper end 13 and shoulder 14 formed on a body which consists in this instance of three head sections 15, each with a leg 17 to support a cantilevered bearing shaft 19. The bearing shaft 19 supports a rotatable cutter 21 having earth disintegrating teeth 23 to dislodge cuttings from bottom of a bore hole in the earth's geological formations. Bearing elements include in this instance roller bearings 25, ball bearings 27, bushing 29 and a thrust bottom 31.

The cutter 21 is retained on the bearing shaft 19 by the ball bearings 27 which, during assembly of the components of the bits, are inserted into a plug hole 33 which receives a ball plug retainer 35, welded at 37 to the leg 17.

The ball plug 35 has, in this instance, a pair of annular grooves 39 and 41. These grooves permit the flow of air on other gas from a drill rig (not shown) at the surface of the earth through: a vortex separator 43, the shank cavity 45 of the bit into a central tube 47 having a valve 49, transverse passage 51, a generally vertical passage 53, and a bearing shaft passage 55.

The bit also includes a plurality of nozzles 57 that communicate with the shank cavity 45, each nozzle having in this instance a back flow valve 59. The vertical passage 53 has an opening 61 at an upper, exterior portion of the leg 17, to receive a removable plug 63. The preferred form of this plug is as shown in FIG. 2, comprising upper and lower plates 65, 67 which confine an elastomeric core 69, having an opening 71 to receive the body of a threaded fastener 73 which is in this instance a bolt with a socket head 75, with a threaded end 77 to engage a mating threaded portion 79 of the lower plate 67.

In operation the threaded upper end 13 of bit 11 is secured to a drill string member that is raised, lowered and rotated by a drill rig at the surface of the earth. A pump associated with the drill rig forces air or gas through the vortex separator 43 and into the shank cavity 45 of the bit. (None of the surface equipment is shown in the drawing—only the bit.) Liquid and solid particles entrained in the air are forced by the vortex toward the outside of the shank cavity 45 and through nozzles 57 and back flow valves 59, which are opened by the downward flow of gas and associated pressure differential.

Some of the air or gas entering shank cavity 45 passes through the opened valve 49 and enters the passages 51, 53 and 55, into and through the clearances and passages between the bearing member of the shaft 19 and cutter 21.

Since some amount of dust and other particles are contained in the air, the passages leading to the bearings may become clogged. When this occurs, the pump is turned off, the valves 49 and 59 become shut because of the bias of springs (not shown) associated with them, to prevent back flow into the bit of water that may be in drilled hole. The removable plug 63 may be taken from the opening 61. This is accomplished by rotating the fastener 73 in a counterclockwise direction (as seen from above), separating the upper and lower plates 65, 67, and allowing a radial contraction of the elastomeric core 69. Then, a rod may be inserted into the vertical passage 53, while simultaneously water is flushed through this passage, to assist in removal of any blockage. After removal of the blockage, the removable plug 63 is reinserted into the opening 61, the fastener 73 rotated clockwise direction (as seen from above) to force the upper and lower plates 65, 67 together and raise or expand the elastomeric core 69 to form an excellent seal with the wall of the passage 53. The bit may then be lowered into the hole, with the assurance that relatively unobstructed flow of air or gas reaches and cools the bearings of the bit.

It should be apparent from the foregoing description that the invention has significant advantages. A convenient access is provided to the passages inside an air bit, due to the orientation and location of the vertical passage 53 and the construction of the removable plug 63. The construction of the removable plug enables convenient removal and replacement in a manner to achieve excellent sealing against the walls of the vertical passage 59, without necessity for having surface finishes other than those obtained by drilling, eliminating the necessity for reaming or grinding. The construction of the removable plug is rugged and can withstand repeated removal and insertion, without loss of sealing effectiveness. The orientation of the drill hole also permits convenient access with a rod or other cleaning implement, in addition to access by cleaning water or other fluids. It is not necessary, for example in the embodiment shown, that the bit be removed from the drill pipe in order for the passages to be accessed and cleaned.

While I have shown my invention in only one of it forms, it should be apparent to those skilled in the art that it is not thus limited, but is susceptible to various changes and modifications without departing from the principles which it embodies.

I claim:

1. In an earth boring bit of the type having a body supporting at least one leg and a rotatable cutter, the improvement which comprises:

the body having a threaded upper end for attachment to a drill string member, including a shoulder;

the body further having an opening located radially outward of the shoulder to provide access when the body is connected to a drill string member;

bearing means formed on a bearing shaft in the leg and in the cutter, including passages for the flow of a gaseous fluid;

passage means extending from the interior of the body to the passages in the bearing;

the passage means including a generally vertical segment connected with the opening in the upper portion of the body;

a removable and at least partially resilient plug secured in the opening or the generally vertical segment for access to the passage means.

2. In an earth boring bit of the type having a body supporting at least one leg and a rotatable cutter, the improvement which comprises:

the body having a threaded upper end for attachment to a drill string member, including a shoulder;

the body further having an opening located radially outward of the shoulder to provide access when the body is connected to a drill string member;

bearing means formed on a bearing shaft between the leg and the interior of the cutter, including passages for the flow of a gaseous fluid to cool the bearing means;

passage means extending from the interior of the body to the passages in the bearing;

separator means near an inlet of the passage means to filter the entering gaseous fluid;

the passage means including a generally vertical segment connected with the opening on the exterior of the body;

a removable plug having an expandable, elastomeric portion secured in the opening to the passage means for allowing access and cleaning thereof by mechanical and fluid means.

3. In an earth boring bit of the type having a body supporting at least one leg and a rotatable cutter, the improvement which comprises:

the body having a threaded upper end for attachment to a drill string member, including a shoulder;

the body further having an opening located radially outward of the shoulder to provide access when the body is connected to a drill string member;

bearing means formed on a bearing shaft between the leg and the interior of the cutter, including passages for the flow of a gaseous fluid to cool the bearing means;

passage means extending from the interior of the body to the passages in the bearing;

the passage means including a generally vertical segment having an opening on the exterior of the body;

a separator means near an inlet of the passage means to filter the entering gaseous fluid;

a removable plug having an expandable, elastomeric portion secured in the opening to the passage means for allowing access and for cleaning thereof by mechanical and fluid means;

the elastomeric portion consisting of a core;

an upper and lower plate at the ends of the core;

a fastener extending between the plates, with a threaded end to engage a mating part of the lower plate to permit selective compression and expansion of the core against the wall of the opening.

* * * * *